US008555928B2

(12) United States Patent
Pustelnik et al.

(10) Patent No.: US 8,555,928 B2
(45) Date of Patent: Oct. 15, 2013

(54) ADAPTER BIT FOR A DEVICE FOR CONNECTING PIPE CONDUITS

(76) Inventors: Philipp Pustelnik, Vienna (AT); Thomas Euler-Rolle, Vienna (AT)

( * ) Notice: Subject to any disclaimer, the term of this patent is extended or adjusted under 35 U.S.C. 154(b) by 913 days.

(21) Appl. No.: 11/921,133

(22) PCT Filed: Mar. 16, 2006

(86) PCT No.: PCT/AT2006/000112

§ 371 (c)(1),
(2), (4) Date: Mar. 12, 2009

(87) PCT Pub. No.: WO2006/125232

PCT Pub. Date: Nov. 30, 2006

(65) Prior Publication Data

US 2010/0133809 A1 Jun. 3, 2010

(30) Foreign Application Priority Data

May 24, 2005 (AT) ..... A 882/2005

(51) Int. Cl.
*F16L 55/10* (2006.01)

(52) U.S. Cl.
USPC ..... 138/90; 138/104; 324/441; 165/DIG. 170

(58) Field of Classification Search
USPC ..... 138/90, 104; 324/441; 165/DIG. 170
See application file for complete search history.

(56) References Cited

U.S. PATENT DOCUMENTS 3,471,393 A * 10/1969 Ingruber ..... 204/409
3,884,640 A * 5/1975 Lock et al. ..... 422/82.03
4,204,246 A * 5/1980 Arii et al. ..... 361/699
4,672,322 A * 6/1987 Gratteau et al. ..... 324/441
4,957,158 A * 9/1990 Ando ..... 165/110
5,062,405 A * 11/1991 Daly ..... 123/468
5,178,213 A 1/1993 Watson et al.
5,450,765 A * 9/1995 Stover ..... 73/866.5
5,466,366 A * 11/1995 Chia-ching ..... 210/85
5,481,240 A * 1/1996 Fukaya et al. ..... 338/22 R
5,724,817 A 3/1998 Nishishita
5,889,460 A * 3/1999 Bachmann et al. ..... 338/28
6,380,746 B1 * 4/2002 Polczynski et al. ..... 324/446
6,404,204 B1 * 6/2002 Farruggia et al. ..... 324/441
7,645,428 B2 * 1/2010 Arencibia, Jr. ..... 422/202
2003/0006029 A1 1/2003 Kelsey
2003/0025325 A1 * 2/2003 Rehmann et al. ..... 285/305
2007/0104247 A1 * 5/2007 Takahashi ..... 374/185

FOREIGN PATENT DOCUMENTS

EP 0983475 9/2002

* cited by examiner

*Primary Examiner* — James Hook
(74) *Attorney, Agent, or Firm* — Cozen O'Connor

(57) ABSTRACT

An adapter cap for the parallelepiped distributor section of a liquid treatment arrangement, which is provided with a flattened section in a corner area, on which the adapter cap can be placed, wherein the adapter cap has a base with a passage for a liquid, which corresponds to the passage for the liquid in the flattened section, and a pipe line connection. The pipe line connection comprises a universal connector, and a receptacle for a temperature sensor, which has been totally embedded into the receptacle by a casting compound, is provided in a base section of the adapter cap, where a connecting cable with an electrical plug connector leading away from the base section is provided, by which the temperature sensor is connectable to a temperature regulating arrangement.

1 Claim, 5 Drawing Sheets

ADAPTER BIT FOR A DEVICE FOR CONNECTING PIPE CONDUITS

RELATED APPLICATIONS

This is a U.S. national stage of application No. PCT/AT2006/000112, filed on 16 Mar. 2006.

This patent application claims priority of Austrian patent application No. A 882/2005, filed 24 May 2005, the disclosure content of which is hereby incorporated by reference.

FIELD OF THE INVENTION

The invention relates to an adapter cap for a device for connecting pipe lines to the distributor section of a liquid treatment arrangement, in particular an hydraulic fluid air cooling apparatus, which is customarily installed in the return portion of a hydraulic fluid operating circuit of mobile or stationary installations.

BACKGROUND OF THE INVENTION

As a rule, the cooling elements of the cooling apparatus through which the hydraulic fluid flows and which are combined into a package consist of aluminum plates and rods, which are surrounded by air fins and are connected with a box-shaped distributor section extending over the top of the package. An installed fan furthermore acts on the cooling elements.

To avoid the necessity of having to stock connectors of different dimensions for different models of cooling apparatus, and to make the installation of the cooling apparatus easier, the parallelepiped distributor section of the liquid treatment arrangement in accordance with EP 0 983 475 B1 is provided in a corner area with a flattened section, in which a passage for a liquid is provided. Furthermore, a hollow adapter cap is provided, which can be placed on this flattened section and is substantially pyramid-shaped and has a base with a passage for a liquid, which corresponds to the passage for the liquid in the flattened section, and a pipe line connection. This allows the installation of the adapter cap on the flattened corner section at different orientations in such a way that, depending on the requirements, the pipe line connector is pointed to the rear, upward or to the side. At the same time it is possible to stock different adapter caps, which are matched in respect to diameter and screw thread to the connecting opening of the pipe lines to be connected, so that in an economically advantageous manner it is necessary to produce and keep in stock only a single model of the liquid treatment arrangement. The content of EP 0 983 475 E1 is hereby incorporated by reference.

However, a problem in regard to this connecting device and its adapter cap resides in that it is necessary to install and connect the temperature sensor required for regulating the cooling apparatus separately at some location of the hydraulic fluid line, or in the cooling apparatus itself, which is relatively expensive constructively and in view of installation technology, and requires a refinishing of the screw threads following the heat treatment, because of which the cooling apparatus can become contaminated by dirt.

SUMMARY OF THE INVENTION

One object of the present invention is to provide an improved connecting device, which requires less outlay for temperature detection and control than previously.

This and other objects are attained in accordance with One aspect of the invention directed to an adapter cap for the parallelepiped distributor section of a liquid treatment arrangement, which is provided with a flattened section in a corner area, on which the adapter cap can be placed, wherein the adapter cap has a base with a passage for a liquid which corresponds to the passage for the liquid in the flattened section, and a pipe line connection. In accordance with the invention, this adapter cap is distinguished in that the pipe line connection is embodied as a universal connector, and that a receptacle for a temperature sensor, which has been embedded into the receptacle by means of a casting compound, is provided in a base section of the adapter cap, wherein a connecting cable with an electrical plug connector leading away from the base section is provided, by means of which the temperature sensor can be connected with a temperature regulating arrangement.

BRIEF DESCRIPTION OF THE DRAWING

In what follows, the invention will be explained in greater detail by means of an exemplary embodiment of an hydraulic fluid air cooling apparatus, making reference to the drawings.

DETAILED DESCRIPTION OF THE DRAWINGS

Figure 1B:
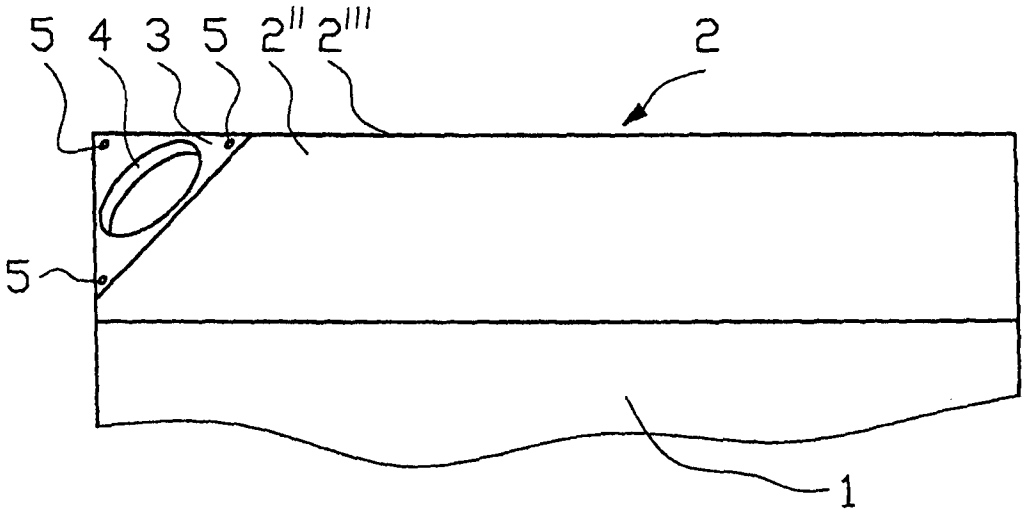
FIG. 1*b* shows a lateral view of FIG. 1*a*.
Figure 1A:
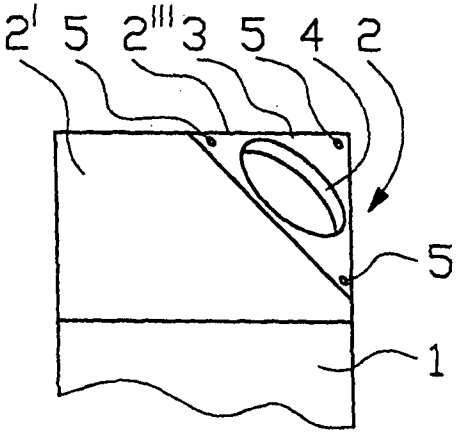
FIG. 1*a* shows the distributor, or head, section of an hydraulic fluid air cooling apparatus in accordance with the invention in a front view.

In accordance with FIG. 1, an hydraulic fluid air cooling apparatus, which is actually formed by a parallelepiped package 1 of spaced-apart aluminum plates, which are provided with air fins, wherein a fan, not shown, is assigned to the package, is provided with a distributor, or head section 2, which is used as a connection with feed and return lines, not shown, on the cooling apparatus and functions as an hydraulic fluid distributor.

In a corner area, the hydraulic fluid distributor section 2, which also has the shape of a parallelepiped or box, is provided with a flattened section 3, which cuts off the corner and makes a transition into the front face 2', the longitudinal side 2" and the top 2''' of the distributor 2.

The flattened section 3 is provided with an oil passage opening 4 of a comparatively large diameter, and with three screw holes 5.

Figure 2:
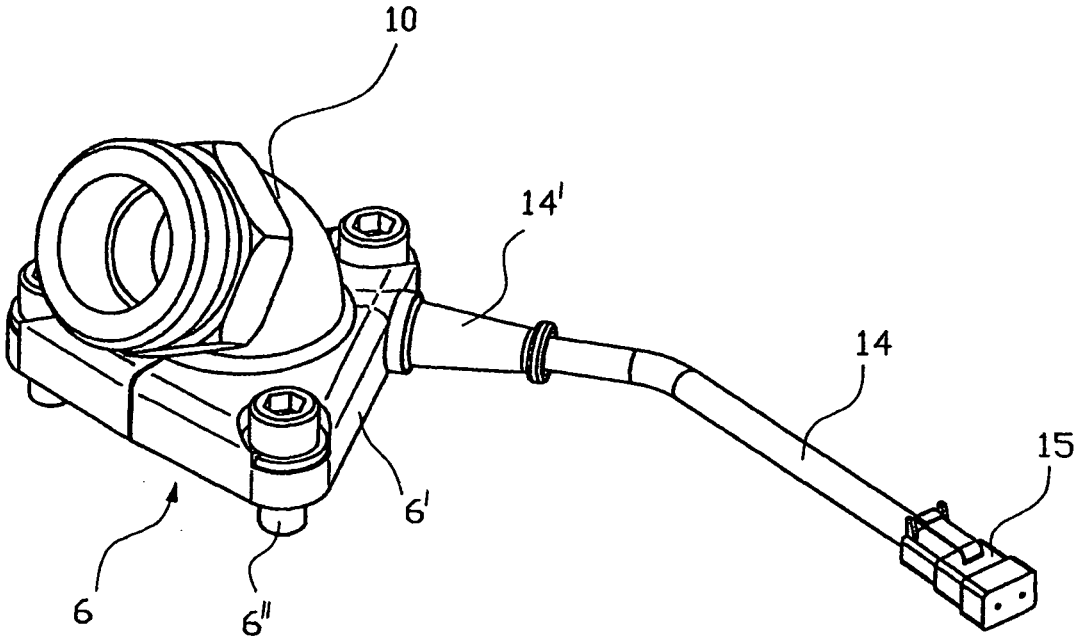
FIG. 2 shows an adapter cap for the head section in a perspective view.
Figure 3:
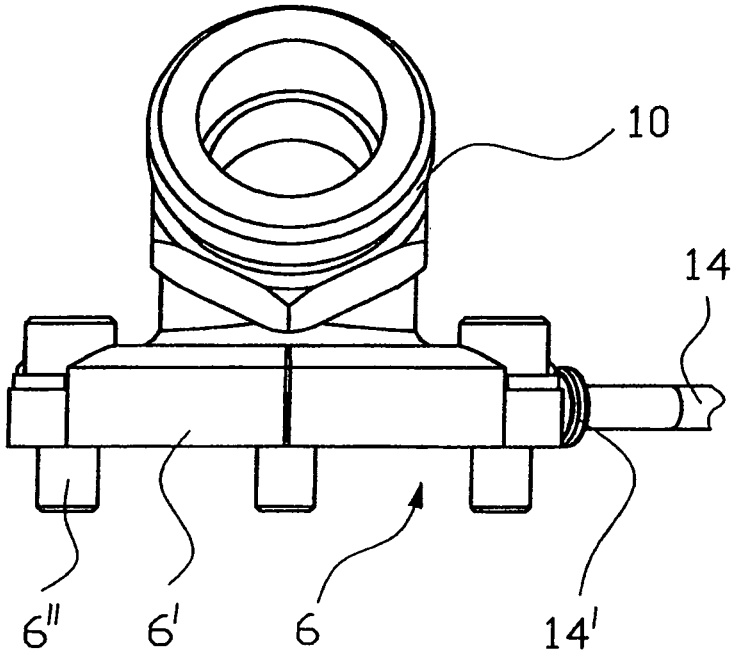
FIG. 3 shows the adapter cap in FIG. 2 seen from the direction of the other side.
Figure 4:
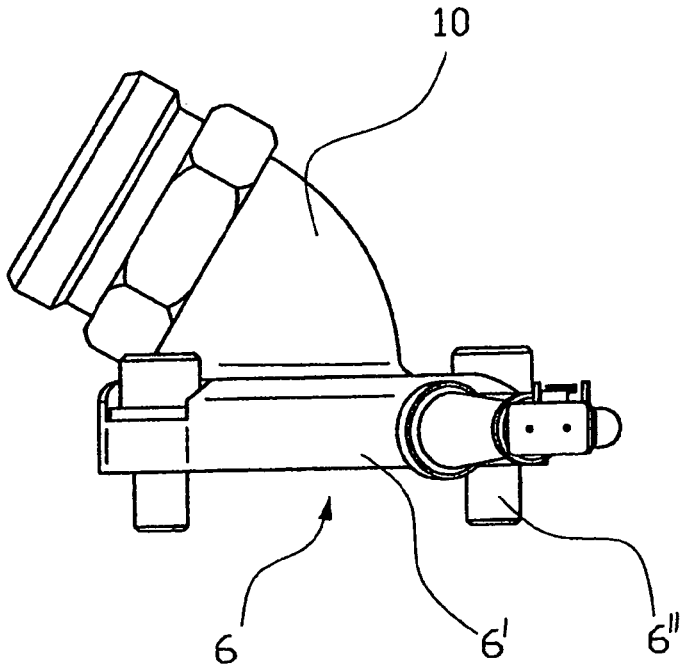
FIG. 4 shows a plan view in the direction of the arrow IV' in FIG. 2.

A hollow adapter cap 6, represented in a perspective view in FIG. 2, and which is substantially triangular in a view from above, is mounted on the flattened section 3. The adapter cap 6 has a substantially triangular base section 6', which is placed on the flattened section 3. The base section 6' is provided with threaded bolts 6", which fit into screw holes 5. In accordance with FIG. 5, the base section 6' has a central connecting opening 7, which corresponds to the oil passage opening 4 of the flattened section 3.

Figure 5:
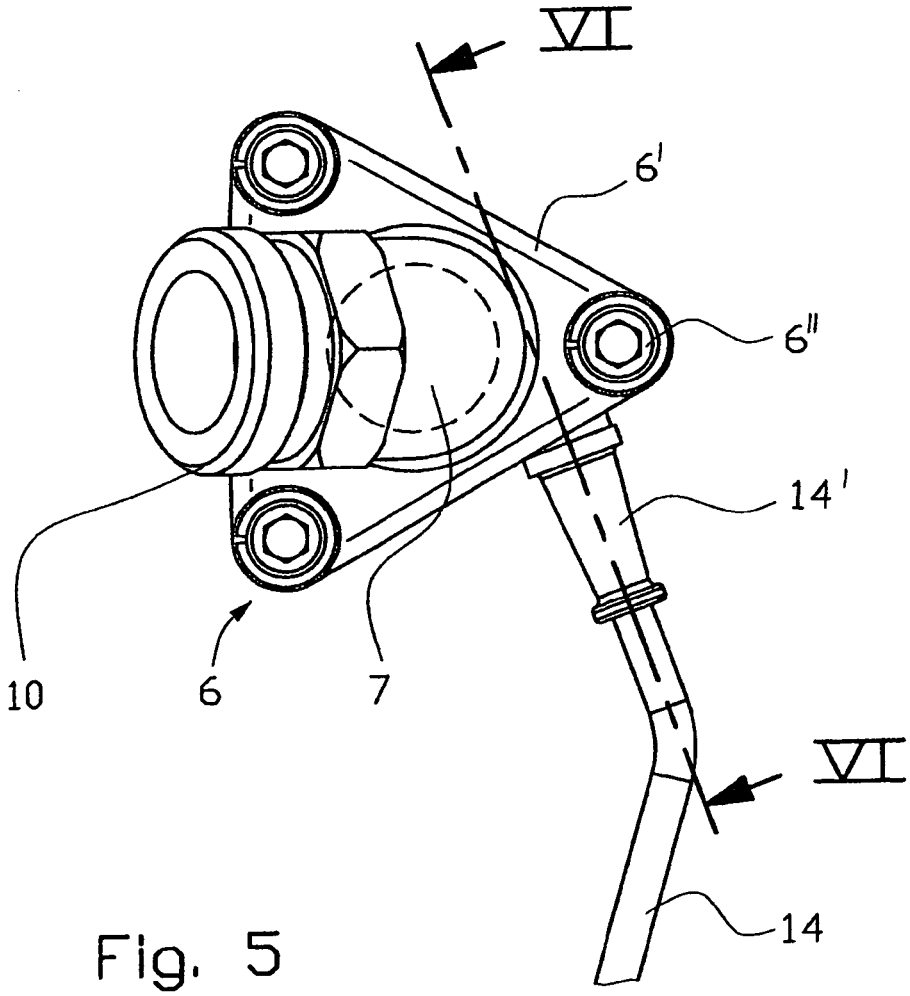
FIG. 5 shows a plan view in the direction of the arrow V in FIG. 2.
Figure 6:
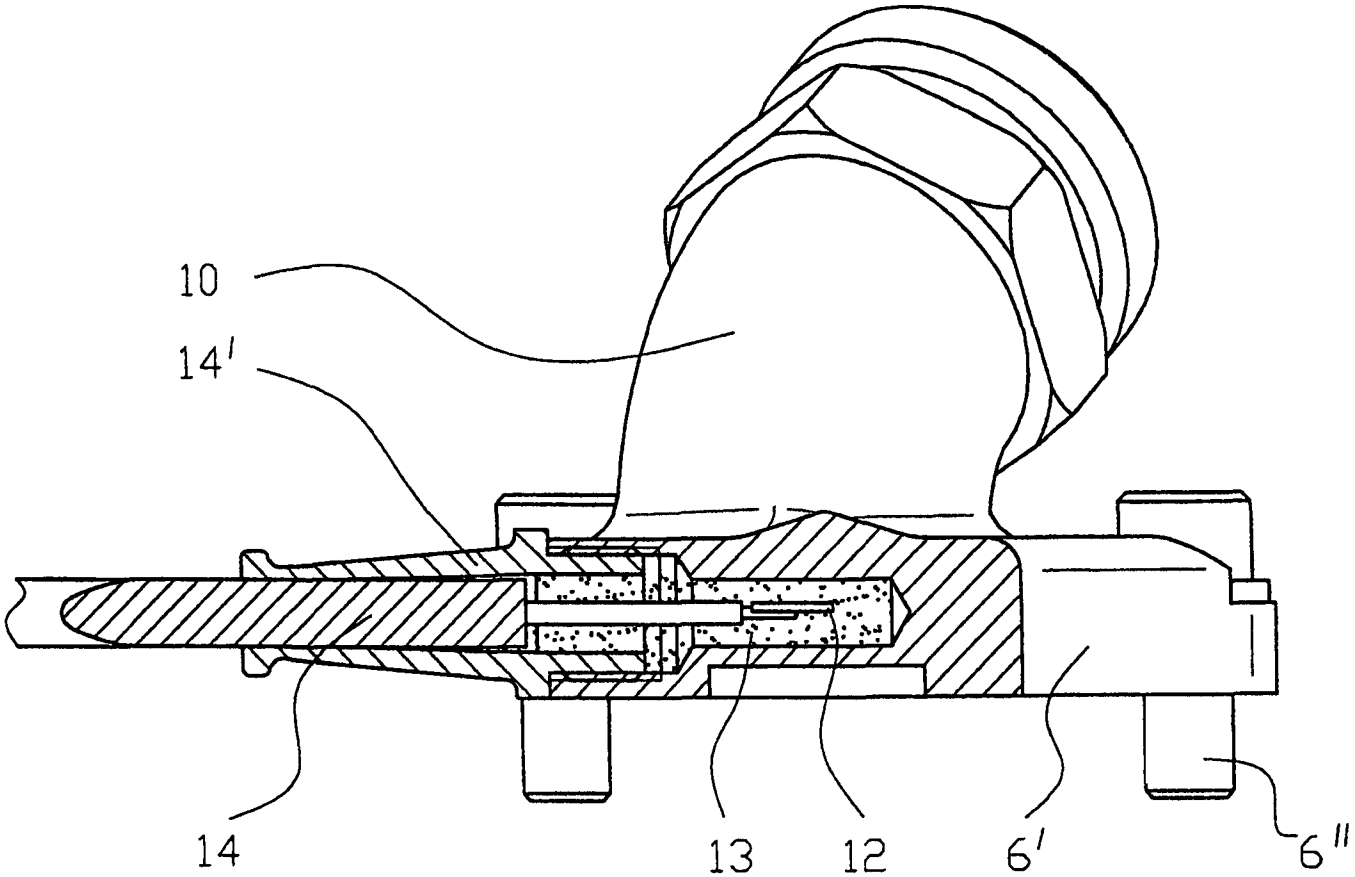
FIG. 6 shows a section through the adapter cap along the line VI-VI in FIG. 5.

It ensues from FIG. 5 that a universal connection piece 10 extends away in a curved manner from the connecting opening 7. The adapter cap 6 is mounted on the distributor 2 in the desired orientation of this connecting piece 10. A receptacle 11 for a temperature sensor 12 is provided in the base section 6' of the adapter cap 6. Temperature sensor 12 has been embedded into the receptacle 11 by means of a casting compound 13, wherein a connecting cable 14 leading out of a cable socket 14' away from the base section 6' is provided with an electrical plug connector 15, by means of which the temperature sensor can be connected with a temperature regulating arrangement, not shown.

Within the scope of the invention, numerous adapter caps 6 with connecting openings of different sizes and universal connecting pieces 10 of various types of threads can be stocked, which can be installed in a simple manner on the same type of hydraulic fluid air cooling apparatus, or other liquid treatment arrangements.

We claim:

1. An adapter cap for an elongated distributor section of a liquid treatment arrangement, which is provided with a flattened section in a corner area, on which the adapter cap is placeable, the adapter cap comprising:

a triangular base section with a passage for a liquid at an end of the adapter cap and configured for placement on a passage for liquid in the flattened section, a pipe line connection at another end of the adapter cap, the pipe line connection comprising a universal connector, a temperature sensor, a receptacle provided in the triangular base section of the adapter cap, the temperature sensor being totally embedded into the receptacle by a casting compound, and a connecting cable with an electrical plug connector leading away from a sidewall of the triangular base section and for connecting the temperature sensor to a temperature regulating arrangement.

* * * * *